United States Patent [19]

Miyamoto

[11] 4,328,966

[45] May 11, 1982

[54] BATTLE SPORT GAME

[76] Inventor: Yukio Miyamoto, 2590 Wetherby Rd., San Marino, Calif. 91108

[21] Appl. No.: 175,131

[22] Filed: Aug. 4, 1980

[51] Int. Cl.[3] ..... A63B 67/00; A63B 69/02; A63B 71/08

[52] U.S. Cl. ..... 273/1 F; 273/67 R; 46/1 R; 2/2.5

[58] Field of Search ..... 273/1 F, 1 G, 84 R, 273/67 R; 272/76, 98; 46/1 R, 148; D22/99; 2/2.5

[56] References Cited

U.S. PATENT DOCUMENTS

| | | | |
|---|---|---|---|
| 2,820,318 | 1/1958 | Guyer | 2/2.5 X |
| 3,848,357 | 11/1974 | Morrison | 46/148 X |
| 3,921,978 | 11/1975 | Warren | 273/67 R |

FOREIGN PATENT DOCUMENTS

| | | | |
|---|---|---|---|
| 4874 | of 1912 | United Kingdom | 273/67 R |

OTHER PUBLICATIONS

Family Weekly Magazine, 12/12/75, p. 15, "Boffers at Play".

Thomas Woroniecki-The Roslyn Gun Shop, Catalog No. 2, p. 45, Nos. 38A & 39A, 4/43.

My Weekly Reader, Edition 5, News Report, vol. 49, Issue 16, 1/27/71.

*Primary Examiner*—Paul E. Shapiro

*Attorney, Agent, or Firm*—William W. Haefliger

[57] ABSTRACT

A battle sport game includes a bat that comprises:

(a) an axially elongated body consisting essentially of lightweight, resiliently compressive material, (b) a handle at one end of the body, and (c) flexible connecting structure extending internally of the body and projecting therefrom, for interconnecting the handle and body.

Also, shield structure is provided.

9 Claims, 7 Drawing Figures

BATTLE SPORT GAME

BACKGROUND OF THE INVENTION

This invention relates to combative games, and more particularly concerns a battle sport game.

It is common knowledge that people frequently engage in mock or earnest physical fighting and similar activity, for reasons such as sport and release of animosities. In order to prevent injury during such fighting, there is need for weapons that can be used by the combatants and which will not inflict injury.

SUMMARY OF THE INVENTION

It is a major object of the invention to provide game weoponry meeting the above needs. Basically, the battle sport game of the invention embodies a non-injurious bat, comprising (a) an axially elongated body consisting essentially of lightweight, resiliently compressive material, (b) a handle at one end of the body, and (c) flexible connecting structure extending internally of the body and projecting therefrom, for interconnecting the handle and body.

As will appear, the flexible body may consist of foamed plastic material given a degree of support with secondary flexibility by means of said connecting structure in the form of a shaft or flexible hose, the latter also supporting the handle so as to flex relative to the body; a protective sleeve may extend about the hose and bridge the junction between body and handle to stiffen their flexible interconnection; and a shield structure may be employed, as will be seen.

These and other objects and advantages of the invention as well as the details of an illustrative embodiment, will be more fully understood from the following description and drawings, in which:

DRAWING DESCRIPTION

DETAILED DESCRIPTION

Figure 5:
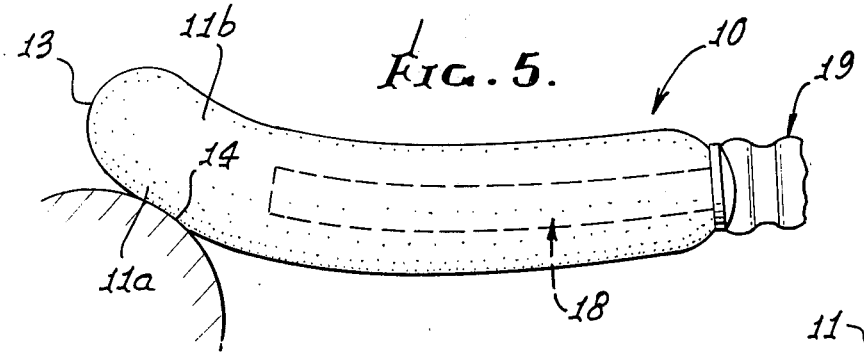
FIG. 5 is a view like FIG. 1, but showing the bat in defected condition when striking an object.
Figure 2:
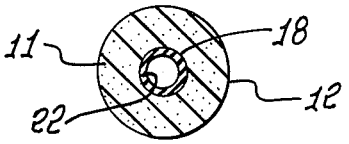
FIG. 2 is a vertical section on lines 2—2 of FIG. 1.
Figure 4:
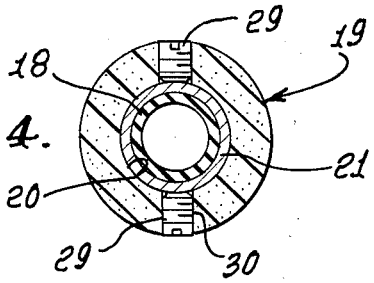
FIG. 4 is an enlarged section on lines 4—4 of FIG. 1.

In FIGS. 1–5, the bat 10 comprises an axially elongated body 11 consisting essentially of lightweight, resiliently compressive material, as for example foam rubber. It has a generally circular periphery 12 in lateral planes normal to the body axis 15, as is clear from FIG. 2. The outer end 13 of the body is convex, so as to be non-injurious to a person struck by the bat. FIG. 5 shows the bat with a body region 11*a* compressed in response to forcible striking of a person's flesh, such as a shoulder 14. Thus, the bat material cushions the blow, and especially the outer end portion 11*b* between end 13 and the outer end 17 of shaft structure 18 embedded in the body.

Figure 1:
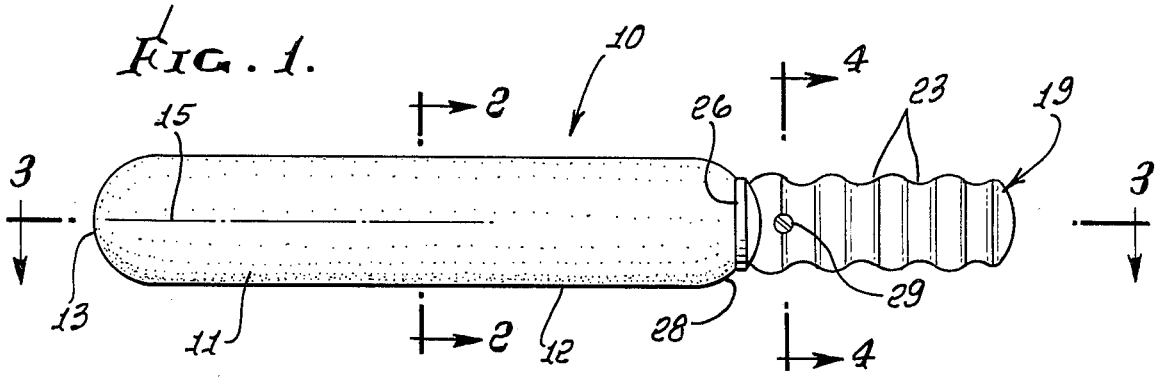
FIG. 1 is a side elevation showing a bat embodying the invention.
Figure 3:
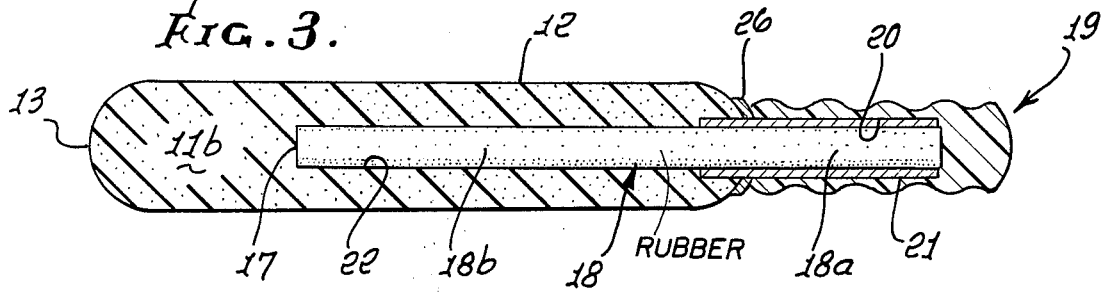
FIG. 3 is a side elevation taken in section on lines 3—3 of FIG. 1.

Structure 18 is flexible and provide a connection to a handle 19 at the opposite end of the body. The handle is tubular, having a bore 20 to receive the portion 18*a* of tubular structure 18 shown in the form of an elastomeric tube such as a rubber hose. A flexible sleeve 21 may surround the hose 18 at its transition between the handle and the tubular bore 22 in body 11. That bore typically extends axially into the body, and beyond its mid-point, to receive the hose portion 18*b*, as shown in FIG. 3. The hose may be bonded to the body 11, sleeve 21 and handle bore, as by an adhesive composition. The handle may have shallow annular grooves 23 spaced along its length, to receive the user's fingers, for better gripping. A protective annular cap 26 extends about sleeve 21 and the hose 18 at the end of the handle closest the body 11, the cap being cupped to fit the convex end 28 of the body.

If desired, set screws 29 may be threadably attached at 30 to side openings on the handle, tightened against the sleeve 21, to attach the handle. Note in FIG. 4 that the cross sectional areas of the hose and sleeve are substantially smaller than the cross sectional area of body 11.

Figure 6:
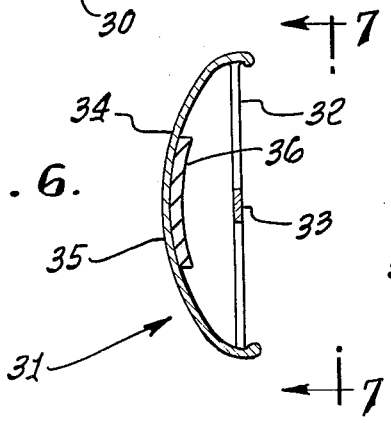
FIG. 6 is a side elevation, in section, through a shield.
Figure 7:
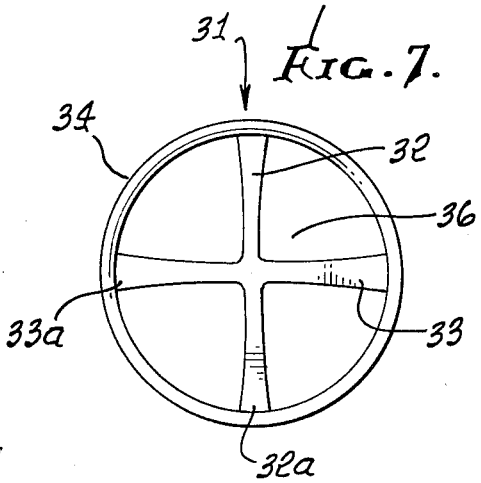
FIG. 7 is a rear elevation taken on lines 7—7 of FIG. 6.

FIGS. 6 and 7 show a shield 31 which an opponent may grip via flexible grips such as thongs 32 and 33. The latter extend generally normal to one another, and their ends 32*a* and 33*a* are suitably attached to the shield body 34. Body 34 is outwardly convex at front side 35. A foam rubber pad insert 36 is centrally attached to the rear side of the body in registration with the centers of the grips or thongs, for protecting the hand of the user.

Sleeve 21 protects the transition between bobdy 10 and handle 19, and is flexible to bend as the shaft 18 bends.

I claim:

1. In a battle sport game, a bat comprising (a) an axially elongated body consisting essentially of lightweight, resiliently compressive material, (b) a handle at one end of the body, and (c) flexible connecting structure extending internally of the body and projecting therefrom, for interconnecting the handle and body, said flexible connecting structure comprising an elongated rubber tube projecting a substantial distance into said elongated body, and also projecting into said handle, (d) and a protective flexible sleeve extending about the rubber tube both within the handle and within the body, the sleeve bridging the junction between the handle and body and terminating a short distance into the body to allow the rubber tube projecting beyond the sleeve in the body to bend laterally with the body and define a corresponding bent position.

2. The bat of claim 1 wherein said body consists of foamed, plastic material.

3. The bat of claim 1 wherein said body consists of foamed elastomeric material.

4. The bat of claim 1 wherein said tube is bonded to the body and handle.

5. The bat of claim 1 wherein the handle has a cross sectional area substantially smaller than the cross sectional area of said body.

6. The bat of claim 1 including an annular protective cup on said sleeve and located at the end of the body closest to the handle to project between the end of the body and the end of the sleeve.

7. The bat of claim 1 wherein said body has a generally circular periphery in lateral planes normal to the body axis, and the end of the body furthest from said handle is convex.

8. The game of claim 1 including a shield engaged by said body, and holder structure adapted to be grasped by a user and connected to the shield.

9. The game of claim 8 wherein said structure has cross arms the outer ends of which are connected to the shield, at one side thereof.

* * * * *